US008078306B2

(12) United States Patent
Nakao et al.

(10) Patent No.: US 8,078,306 B2
(45) Date of Patent: Dec. 13, 2011

(54) POLISHING APPARATUS AND POLISHING METHOD

(75) Inventors: Hidetaka Nakao, Tokyo (JP); Eisaku Hayashi, Tokyo (JP); Kunio Oishi, Tokyo (JP); Isao Hayakawa, Tokyo (JP); Yoshiaki Miyake, Tokyo (JP); Yoshikuni Tateyama, Kanagawa (JP); Takeshi Ashihara, Oita (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 507 days.

(21) Appl. No.: 12/289,507

(22) Filed: Oct. 29, 2008

(65) Prior Publication Data

US 2009/0111358 A1 Apr. 30, 2009

(30) Foreign Application Priority Data

Oct. 31, 2007 (JP) ..... 2007-283039

(51) Int. Cl.
*G06F 19/00* (2011.01)

(52) U.S. Cl. ..... 700/121; 700/164

(58) Field of Classification Search ..... 700/117, 700/121, 164

See application file for complete search history.

(56) References Cited

U.S. PATENT DOCUMENTS 6,231,425 B1 * 5/2001 Inaba et al. ..... 451/5
6,416,617 B2 * 7/2002 Yoshida et al. ..... 156/345.13
6,517,412 B2 * 2/2003 Lee et al. ..... 451/5
7,108,580 B2 * 9/2006 Ushio et al. ..... 451/8
7,475,368 B2 * 1/2009 Angyal et al. ..... 716/136

FOREIGN PATENT DOCUMENTS

| | | |
|---|---|---|
| JP | 2004-106123 | 4/2004 |
| JP | 2004-158506 | 6/2004 |
| JP | 2005-342841 | 12/2005 |
| WO | 2004-035265 | 4/2004 |

* cited by examiner

*Primary Examiner* — Kakali Chaki
*Assistant Examiner* — Carlos Ortiz Rodriguez
(74) *Attorney, Agent, or Firm* — Wenderoth, Lind & Ponack, L.L.P.

(57) ABSTRACT

An apparatus polishes an object material such as a film on a substrate. This apparatus includes a polishing table for holding a polishing pad having a polishing surface, a motor configured to drive the polishing table, a holding mechanism configured to hold a substrate having an object material to be polished and to press the substrate against the polishing surface, a dresser configured to dress the polishing surface, and a monitoring unit configured to monitor a removal amount of the object material. The monitoring unit is operable to calculate the removal amount of the object material using a model equation containing a variable representing an integrated value of a torque current of the motor when polishing the object material and a variable representing a cumulative operating time of the dresser.

9 Claims, 7 Drawing Sheets

POLISHING APPARATUS AND POLISHING METHOD

BACKGROUND OF THE INVENTION

1. Field of the Invention

The present invention relates to an apparatus and method for polishing an object material while estimating a removal amount of the object material using a model equation.

2. Description of the Related Art

An interlevel dielectric having a low dielectric constant is an essential technology for a high-density multi-level interconnect structure. This is because a smaller distance between layered metal interconnects results in a larger line-to-line capacitance, which causes a delay in signal transmission through the interconnects. Thus, there has recently been a trend to use a low-k material having a low dielectric constant as the interlevel dielectric. The low-k material has an advantage of having a low dielectric constant, but on the other hand, the low-k material has low mechanical strength and is relatively easily removed from a substrate. Thus, in order to prevent removal of the low-k material, a hard mask film may be formed on the low-k material.

FIG. 1 is a schematic view showing a part of a multi-level interconnect structure. As shown in FIG. 1, a hard mask film is formed on a low-k interlevel dielectric (hereinafter, this will be referred to as a low-k film). A barrier film is formed on the hard mask film, and a Cu film, which provides an interconnect metal, is further formed on the barrier film. These layered films form a multilayer structure, on which other multilayer structures are formed repeatedly. The multi-level interconnect structure is composed of a plurality of such multilayer structures at different levels.

When forming a new multilayer structure on the multilayer structure shown in FIG. 1, unwanted films are removed using a polishing apparatus. Since the hard mask film functions as a protective film for the low-k film, polishing should be stopped when the hard mask film remains with a certain thickness. Specifically, in FIG. 1, polishing is to be stopped after the barrier film is completely removed and before the hard mask is completely removed. Therefore, it is necessary to monitor a thickness of the hard mask film during polishing so as to accurately detect a polishing end point.

There are several techniques for monitoring a film thickness during polishing, such as a method using an optical sensor and a method using an eddy current sensor. However, the hard mask film is generally as thin as 50 nm to 60 nm, and this film is an oxide film. Consequently, it is difficult to accurately monitor a change in thickness of the hard mask film using these polishing end point detection techniques.

SUMMARY OF THE INVENTION

The present invention has been made in view of the above drawbacks. It is therefore an object of the present invention to provide a polishing apparatus and polishing method capable of polishing an object material while accurately monitoring a change in thickness of the object material.

One aspect of the present invention provides a polishing apparatus including a polishing table for holding a polishing pad having a polishing surface, a motor configured to drive the polishing table, a holding mechanism configured to hold a substrate having an object material to be polished and to press the substrate against the polishing surface, a dresser configured to dress the polishing surface, and a monitoring unit configured to monitor a removal amount of the object material. The monitoring unit is operable to calculate the removal amount of the object material using a model equation containing a variable representing an integrated value of a torque current of the motor when polishing the object material and a variable representing a cumulative operating time of the dresser.

In this specification, the removal amount means an amount by which a thickness of the object material is reduced.

In a preferred aspect of the present invention, the object material comprises a film that belongs to one of levels of a multi-level interconnect structure, and the model equation contains variables representing a level number to which the film belongs.

In a preferred aspect of the present invention, the level number is a level number of a group composed of plural levels having structures similar to each other.

In a preferred aspect of the present invention, the model equation is a multiple regression equation created from a multiple regression analysis on data including removal amounts of the object material on plural substrates polished, integrated values of the torque current, cumulative operating times of the dresser, and level numbers.

Another aspect of the present invention provides a method for polishing a substrate using a polishing apparatus having a polishing pad with a polishing surface, a polishing table holding the polishing pad, a motor configured to drive the polishing table, a holding mechanism configured to hold a substrate having an object material to be polished and to press the substrate against the polishing surface, and a dresser configured to dress the polishing surface. The method includes creating a model equation for calculating a removal amount of the object material, the model equation containing a variable representing an integrated value of a torque current of the motor and a variable representing a cumulative operating time of the dresser, polishing the object material by bringing the object material into sliding contact with the polishing surface, and calculating the removal amount of the object material by substituting the cumulative operating time of the dresser and the integrated value of the torque current of the motor when polishing the object material into the model equation.

According to the present invention, the removal amount can be estimated accurately using the model equation. Therefore, polishing can be stopped at a desired time point.

DETAILED DESCRIPTION OF THE PREFERRED EMBODIMENTS

Embodiments of the present invention will be described below with reference to the drawings.

Figure 2:
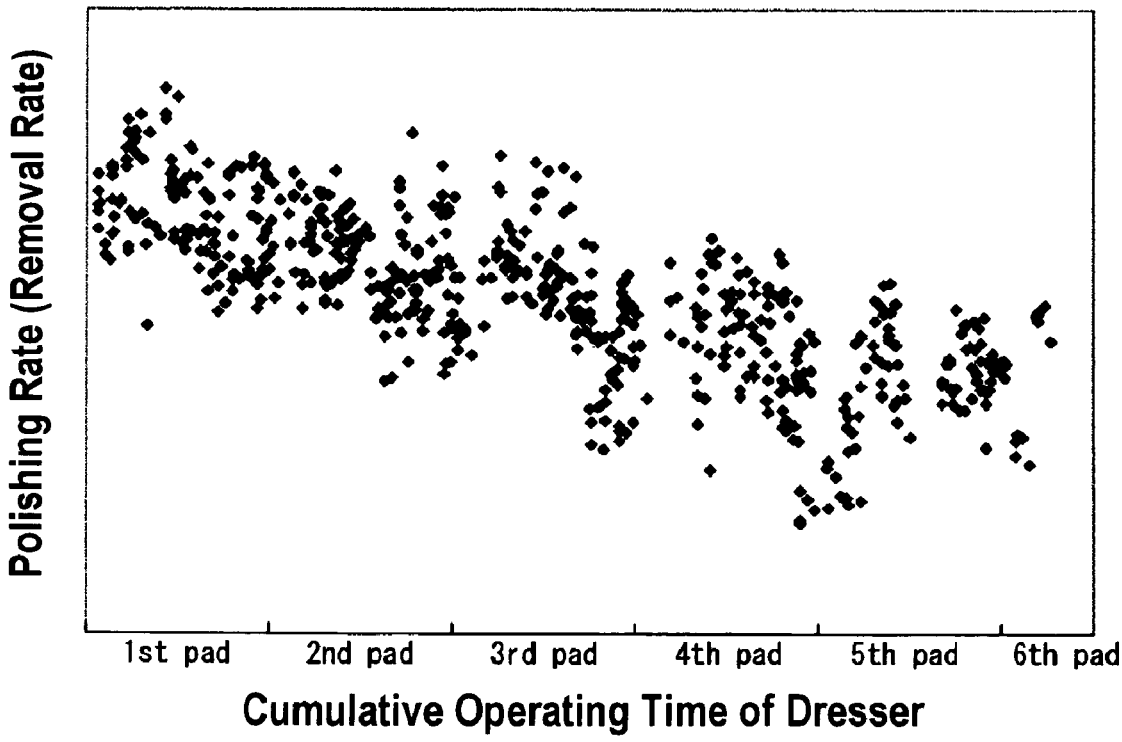
FIG. 2 is a diagram created by plotting data, obtained from plural substrates polished, on a coordinate system having a vertical axis as a polishing rate and a horizontal axis as a cumulative operating time of a dresser.

The inventors have studied effects of a cumulative operating time of a dresser (or a conditioner), which is to perform dressing (conditioning) of a polishing surface of a polishing pad, on a polishing rate (i.e., a removal rate). As a result, the inventors have discovered that there is a correlation between the cumulative operating time of the dresser and the polishing rate. FIG. 2 is a diagram showing data obtained from plural substrates polished. In FIG. 2, the data are plotted on a coordinate system having a vertical axis representing a polishing rate (removal rate) and a horizontal axis representing a cumulative operating time of a dresser. It can be seen from FIG. 2 that the polishing rate decreases as the cumulative operating time of the dresser increases.

In general, a dresser has a longer lifetime than a polishing pad. Therefore, it is normal that plural polishing pads are replaced with new polishing pads before a dresser is replaced with a new dresser. FIG. 2 shows the data that have been obtained until six polishing pads are replaced. As can be seen from FIG. 2, although the polishing pad is replaced with a new polishing pad, the polishing rate decreases according to an increase in the cumulative operating time of the dresser. This is because a dressing performance of the dresser is gradually lowered as the operating time of the dresser accumulates. From this relationship between the cumulative operating time of the dresser and the polishing rate, it can be seen that a removal amount of a film as an object material (i.e., a reduction in thickness of a film) is affected by the cumulative operating time of the dresser.

Figure 3:
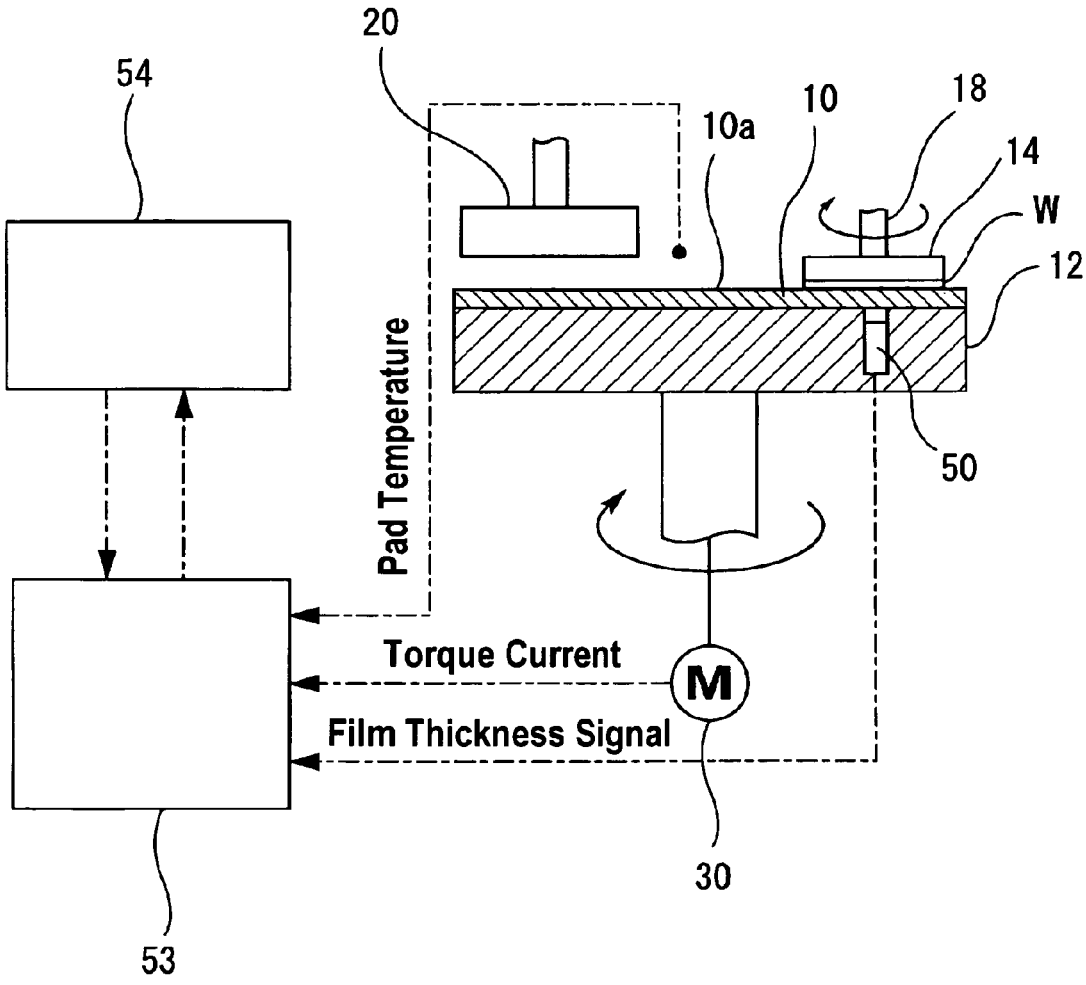
FIG. 3 is a schematic view showing a polishing apparatus according to an embodiment of the present invention.

FIG. 3 is a schematic view showing a polishing apparatus according to an embodiment of the present invention. As shown in FIG. 3, the polishing apparatus has a polishing pad 10 having a polishing surface 10*a*, a polishing table 12 holding the polishing pad 10, a motor 30 configured to drive the polishing table 12, a top ring (a holding mechanism) 14 configured to hold a substrate (e.g., a semiconductor wafer) W and to press the substrate W against the polishing surface 10*a* of the polishing pad 10, a dresser 20 configured to dress the polishing surface 10*a*, a monitoring unit 53 configured to monitor a removal amount of an object material on the substrate W, and a control unit 54 configured to control operations of the polishing apparatus.

The polishing table 12 is coupled to the motor 30 via a rotational shaft, and is rotatable about its own axis as indicated by arrow. A polishing liquid supply nozzle (not shown) is disposed above the polishing table 12, so that a polishing liquid is supplied from the polishing liquid supply nozzle onto the polishing surface 10*a* of the polishing pad 10.

The top ring 14 is coupled to a top ring shaft 18, which is coupled to a motor and an elevating cylinder (not shown). The top ring 14 can thus be moved vertically and rotated about the top ring shaft 18. The substrate is attracted to and held on a lower surface of the top ring 14 by a vacuum attraction or the like.

With the above-described structures, the substrate W, held on the lower surface of the top ring 14, is rotated and pressed by the top ring 14 against the polishing surface 10*a* of the polishing pad 10 on the rotating polishing table 12. The polishing liquid is supplied from the polishing liquid supply nozzle onto the polishing surface 10*a* of the polishing pad 10. The object material on the substrate W is thus polished in the presence of the polishing liquid between the substrate W and the polishing surface 10*a*. In this embodiment, the polishing table 12 and the top ring 14 constitute a mechanism of providing relative motion between the substrate W and the polishing pad 10.

Figure 1:
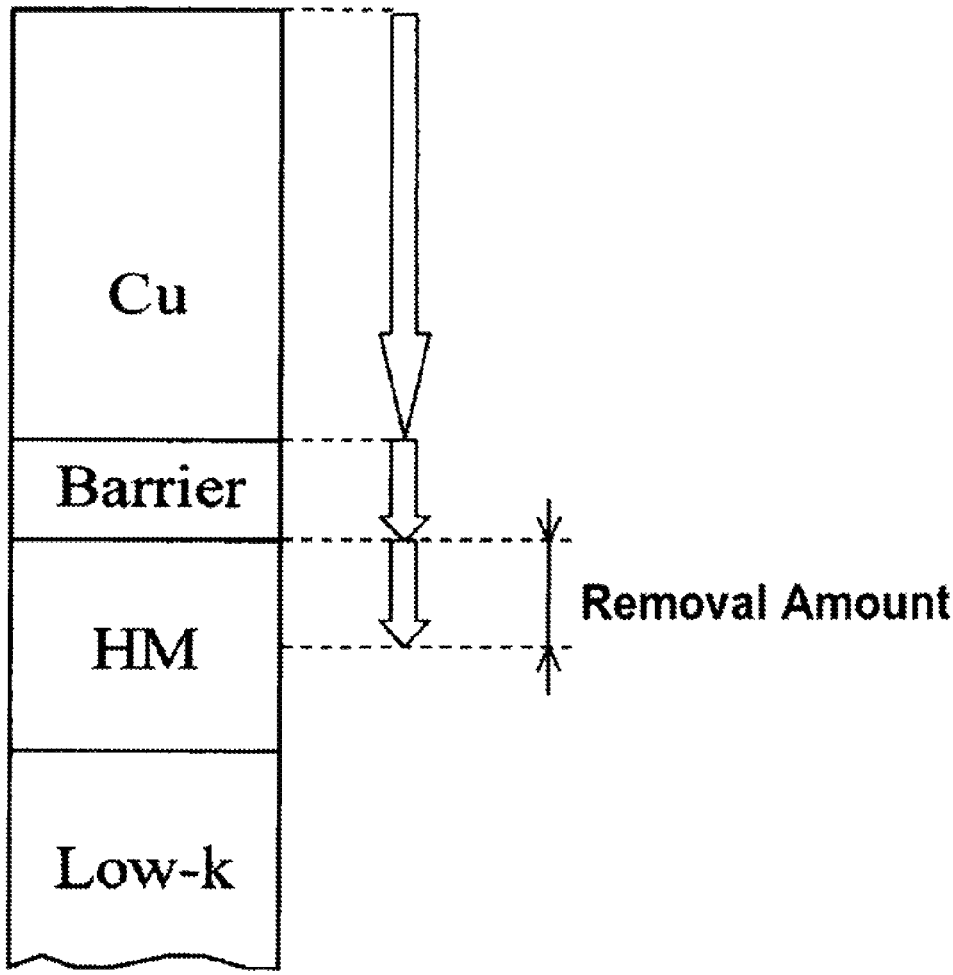
FIG.1 RELATED ART
FIG. 1 is a schematic view showing a part of a multi-level interconnect structure.

The object material is an interconnect metal film (e.g., a Cu film), a barrier film, and a hard mask film which constitute a multi-level interconnect structure on the surface of the substrate W (see FIG. 1). An eddy current sensor 50 is provided in the polishing table 12. This eddy current sensor 50 is configured to output a signal that changes depending on a thickness of the object material. The output signal of the eddy current sensor 50 is sent to the monitoring unit 53.

Figure 4:
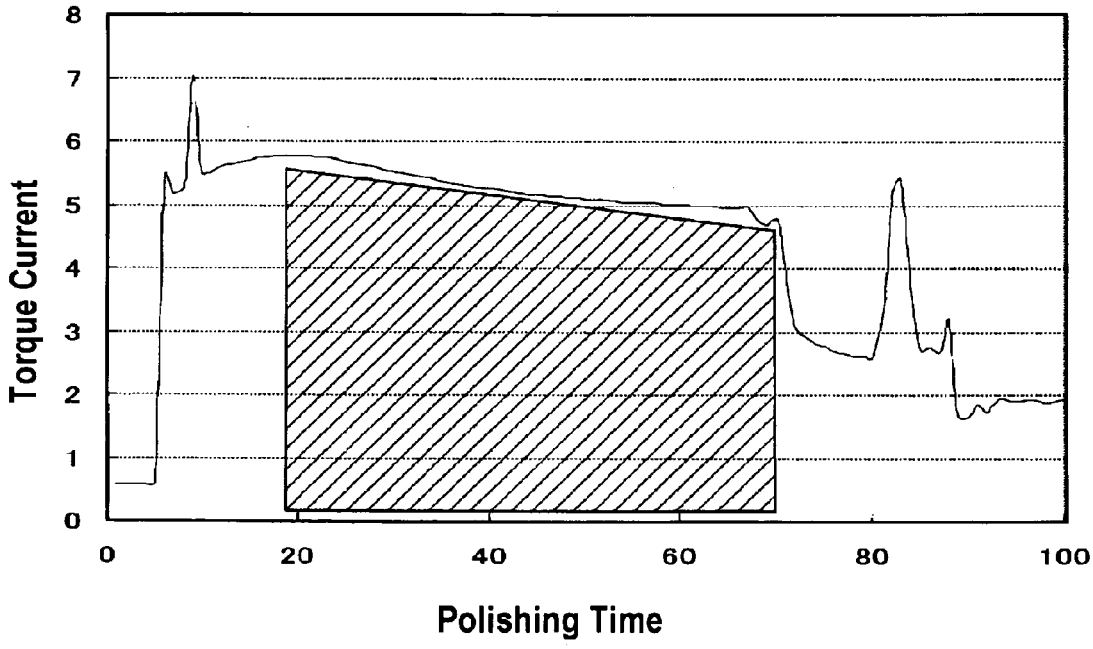
FIG. 4 is a diagram showing a torque current that changes with a polishing time.

The monitoring unit 53 is configured to acquire a value of a torque current of the motor 30 and to calculate an integrated value of the torque current. FIG. 4 is a diagram showing the torque current value that changes with a polishing time. In general, an average value of the torque current during polishing is substantially proportional to a polishing rate (removal rate). Therefore, an approximate removal amount can be obtained by calculating the integrated value of the torque current, i.e., an area indicated by oblique lines in FIG. 4. A start point of the integration in FIG. 4 is a polishing end point of the barrier film, i.e., a polishing start point of the hard mask film. An end point of the integration in FIG. 4 is a polishing end point of the hard mask film. The polishing end point of the barrier film (i.e., the polishing start point of the hard mask film) can be detected based on a change in the torque current, as shown in FIG. 4. Further, since the barrier film and the hard mask film generally have different physical properties, the polishing end point of the barrier film (i.e., the polishing start point of the hard mask film) can be detected by the eddy current sensor or an optical sensor as well.

Figure 5:
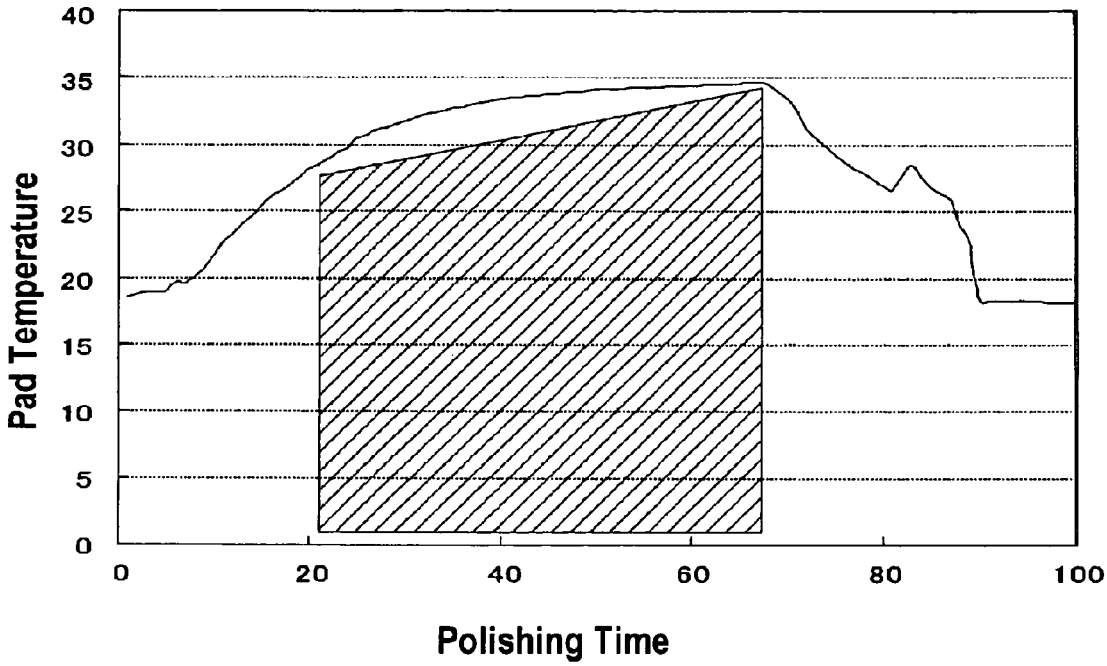
FIG. 5 is a diagram showing a temperature of a polishing pad that changes with a polishing time.

The approximate removal amount can also be obtained by an integrated value of a temperature of the polishing pad 10, instead of the torque current. FIG. 5 is a diagram showing the temperature of the polishing pad 10 that changes with the polishing time. In general, an average temperature of the polishing pad 10 is substantially proportional to the polishing rate (i.e., the removal rate). Therefore, the approximate removal amount can be obtained by calculating the integrated value of the temperature of the polishing pad 10, i.e., an area indicated by oblique lines in FIG. 5. The temperature of the polishing pad 10 can be measured by a temperature sensor (not shown in the drawing) disposed above the polishing pad 10.

In this embodiment, the interconnect film and the barrier film, each of which is a conductive film, are polished while each thickness (i.e., the removal amount) is monitored by the monitoring unit 53 based on the output signal of the eddy current sensor 50. On the other hand, the hard mask film, which is an oxide film, is polished while an estimated removal amount thereof is monitored by the monitoring unit 53. The estimated removal amount is calculated using a model equation which will be discussed below.

The model equation is a relational expression containing variables that represent the cumulative operating time of the dresser 20, the integrated value of the torque current, and a level number to which the hard mask film (the object of polishing) belongs. Specifically, the model equation is expressed as follow.

$$Y = a_0 + a_1 \cdot X_1 + a_2 \cdot X_2 + a_3 \cdot X_3 + a_4 \cdot X_4 + a_5 \cdot X_5 + a_6 \cdot X_6 + a_7 \cdot X_7 + a_{n-2} \cdot X_{n-2} + a_{n-1} \cdot X_{n-1} + a_n \cdot X_n \quad (1)$$

This model equation is a multiple regression equation, wherein Y is a response variable (or dependent variable) representing the estimated removal amount of the hard mask film, $a_0$ through $a_n$ are partial regression coefficients, and $X_1$ through $X_n$ are explanatory variables.

In the above model equation, $X_1$ through $X_{n-2}$ are dummy variables which are used to quantify a qualitative variable, i.e., a level number to which the hard mask film belongs. Specifically, $X_1$ through $X_{n-2}$ are 0 or 1, so that combinations of 0 and 1 represent the level number. For example, when the hard mask film, which is the object to be polished, belongs to a first level, $X_i$ is 1, and $X_2$ through $X_{n-2}$ are 0. Similarly, when the hard mask film belongs to a second level, $X_2$ is 1, and $X_1$, $X_3$ through $X_{n-2}$ are 0. When the hard mask film belongs to an n−1th level, $X_1$ through $X_{n-2}$ are all 0.

In this manner, the total number of dummy variables introduced in the model equation is smaller by one than the total number of levels constituting the multi-level interconnect structure. In this embodiment, the levels are consecutively numbered such that a first level, a second level, a third level, . . . , an n−1th level are allotted in the order from a lower level to an upper level. In the above-described model equation, the variable $X_{n-1}$ is a quantitative variable representing the cumulative operating time of the dresser 20, the variable $X_n$ is a quantitative variable representing the integrated value of the torque current, and the partial regression coefficients $a_0$ through $a_n$ are coefficients given in advance by multiple regression analysis.

When forming the multi-level interconnect structure, the interconnect metal film, the barrier film, the hard mask film, and the like are formed in each level, and these films are polished to form a flat surface. Generally, when polishing the multi-level interconnect structure, a polishing rate (removal rate) slightly varies depending on the level the film belongs to, even if the same kind of film is polished. For example, in a case of polishing a six-level interconnect structure, a polishing rate of a hard mask film in a first level is different from a polishing rate of a hard mask film in a sixth level. In other words, there is a correlation between the polishing rate and the level. Therefore, by reflecting the level number, to which the hard mask film belongs, in the model equation, more accurate removal amount can be estimated.

As an example, when a multi-level interconnect structure is composed of six levels, the above-described model equation (1) is expressed as follow.

$$Y=a_0+a_1\cdot X_1+a_2\cdot X_2+a_3\cdot X_3+a_4\cdot X_4+a_5\cdot X_5+a_6\cdot X_6+a_7\cdot X_7 \quad (2)$$

In this equation (2), the variables $X_1$ through $X_5$ are the dummy variables representing what level the hard mask film belongs to, the variable $X_6$ is the quantitative variable representing the cumulative operating time of the dresser 20, and the variable $X_7$ is the quantitative variable representing the integrated value of the torque current.

In this example, when the hard mask film, which is the object to be polished, belongs to the first level, $X_1$ is 1, and $X_2$ through $X_5$ are 0. When the hard mask film belongs to the second level, $X_2$ is 1, and $X_1$, $X_3$ through $X_5$ are 0. When the hard mask film belongs to the third level, $X_3$ is 1, and $X_1$, $X_2$, $X_4$, $X_5$ are 0. When the hard mask film belongs to the fourth level, $X_4$ is 1, and $X_1$ through $X_3$, $X_5$ are 0. When the hard mask film belongs to the fifth level, $X_5$ is 1, and $X_1$ through $X_4$ are 0. When the hard mask film belongs to the sixth level, $X_1$ through $X_5$ are 0. In this manner, the level number, which is the qualitative variable, is quantified.

The partial regression coefficients $a_0$ through $a_n$ are given by the multiple regression analysis as follows. First, data of the above-described response variables and explanatory variables obtained by polishing multi-level interconnect structures on plural substrates are prepared. More specifically, data including removal amounts (actual removal amounts) of the hard mask films, the level numbers to which these hard mask films belong, the cumulative operating times of the dresser 20, and the integrated values of the torque current used in polishing of the hard mask films are prepared. These data are inputted to the monitoring unit 53. Then, the monitoring unit 53 calculates the partial regression coefficients $a_0$ through $a_n$ from the data using formulas of the multiple regression analysis. The calculation of the partial regression coefficients may be conducted by another device and the resultant partial regression coefficients may be inputted to the monitoring unit 53. The formulas of the multiple regression analysis are known in the art, as disclosed in "Introduction of Multivariate Analysis" (by Yasushi Nagata, etc., published by SAIENSU-SHA Co. Ltd., Japan).

Next, processing flow for obtaining the removal amount of the hard mask film using the above-described model equation will be described. First, the level number to which the hard mask film (i.e., the object to be polished) belongs is inputted into the monitoring unit 53 from the control unit 54, so that the value (0 or 1) of each of the variables $X_1$ through $X_{n-2}$ is determined. Further, the cumulative operating time of the dresser 20 is inputted into the monitoring unit 53 from the controller 54, so that the value of the variable $X_{n-1}$ is determined.

During polishing of the hard mask film, the monitoring unit 53 calculates the integrated value of the torque current at certain time intervals, and substitutes the resultant value for the variable $X_n$ of the model equation. Thus, the estimated removal amount, i.e., the response variable of the model equation, increases according to an increase in the value of the variable $X_n$. When the estimated removal amount reaches a preset target value, the monitoring unit 53 sends a polishing end point signal to the control unit 54. Upon receiving this polishing end point signal, the control unit 54 stops the polishing operation.

After polishing, an actual removal amount is measured using a film-thickness measuring device (not shown in the drawing) installed in the polishing apparatus. The actual removal amount measured is stored as data together with the estimated removal amount calculated, the level number, the cumulative operating time of the dresser 20, and the integrated value of the torque current, in the monitoring unit 53. The monitoring unit 53 calculates a difference between the estimated removal amount and the actual removal amount. If the difference is larger than a first threshold, the monitoring unit 53 recalculates the partial regression coefficients $a_0$ through $a_n$ from the newly obtained data so as to update (or renew) the model equation. If the difference is larger than a second threshold (>the first threshold), the monitoring unit 53 judges that a polishing failure has occurred, and produces an alarm.

The larger total number of partial regression coefficients requires the larger number of data to be prepared for calculating the partial regression coefficients. In other words, if the total number of partial regression coefficients can be reduced, the data to be prepared can also be reduced. Therefore, plural levels having similar structures may be grouped into a single level in the multi-level interconnect structure. For example, in the six-level interconnect structure, the first level and the second level, which have structures similar to each other, may be grouped into a first level, the third level and the fourth level, which have structures similar to each other, may be grouped into a third level, and the fifth level and the sixth level, which have structures similar to each other, may be grouped into a fifth level. In this case, the above-described equation (2) is expressed as follow.

$$Y=a_0+a_1 \cdot X_1+a_2 \cdot X_2+a_3 \cdot X_3+a_4 \cdot X_4 \quad (3)$$

In this equation, the dummy variables are $X_1$ and $X_2$. When the hard mask film, which is the object to be polished, belongs to the first level or second level, $X_1$ is 1, and $X_2$ is 0. When the hard mask film belongs to the third level or fourth level, $X_2$ is 1, and $X_1$ is 0. When the hard mask film belongs to the fifth level or sixth level, $X_1$ and $X_2$ are 0. The variable $X_3$ represents the cumulative operating time of the dresser, and the variable $X_4$ represents the integrated value of the torque current.

Figure 6:
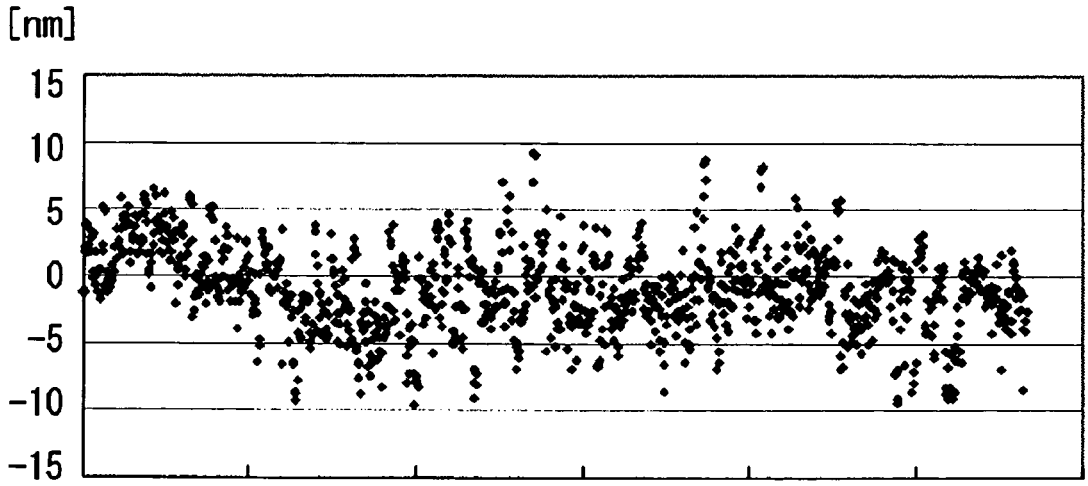
FIG. 6 is a diagram created by plotting an error between an actual removal amount and a removal amount calculated using a model equation having dummy variables for respective levels.
Figure 7:
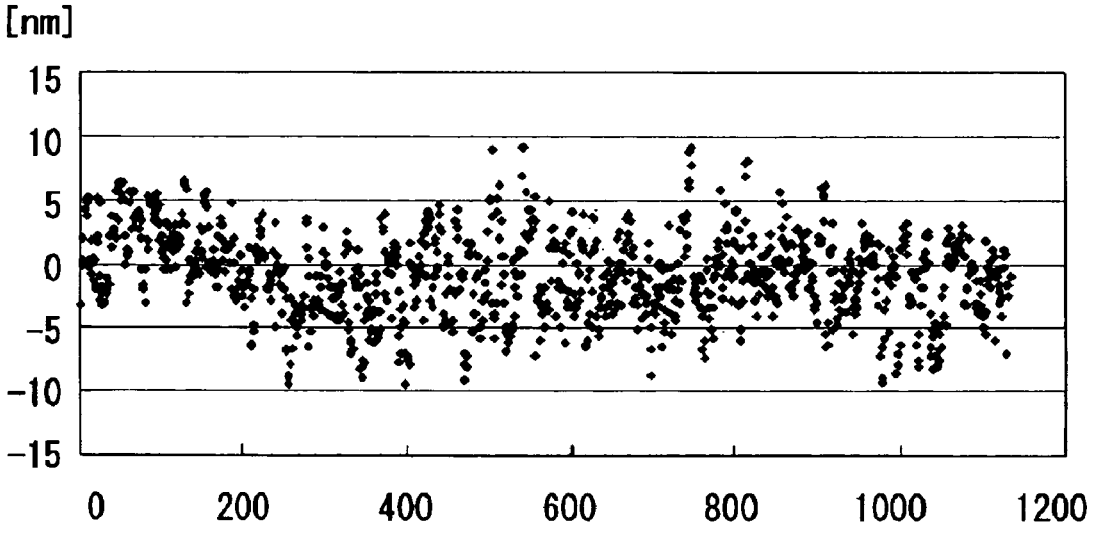
FIG. 7 is a diagram created by plotting an error between an actual removal amount and a removal amount calculated using a model equation having dummy variables for respective grouped levels.

FIG. 6 is a diagram created by plotting an error between the actual removal amount and the removal amount calculated using the model equation (2) having the dummy variables for respective levels, and FIG. 7 is a diagram created by plotting an error between the actual removal amount and the removal amount calculated using the model equation (3) having dummy variables for respective grouped levels. FIGS. 6 and 7 show that, in both cases, the errors are within a range of −10 nm to +10 nm and that substantially the same results can be obtained.

As described above, according to this embodiment, an accurate removal amount can be estimated. Hence, polishing can be stopped when a desired removal amount is reached.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A polishing apparatus comprising:

a polishing table for holding a polishing pad having a polishing surface;

a motor configured to drive said polishing table;

a holding mechanism configured to hold a substrate having an object material to be polished and to press the substrate against the polishing surface, the object material belonging to one of a plurality of levels of a multi-level interconnect structure;

a dresser configured to dress the polishing surface; and a monitoring unit configured to monitor a removal amount of the object material, said monitoring unit being operable to calculate the removal amount of the object material by quantifying a level number to which the object material belongs using a model equation containing a variable representing an integrated value of a torque current of said motor when polishing the object material, a variable representing a cumulative operating time of said dresser, and variables representing the level number to which the object material belongs and by substituting the cumulative operating time of said dresser and the integrated value of the torque current of said motor when polishing the object material into the model equation.

2. The polishing apparatus according to claim 1, wherein the object material comprises a film.

3. The polishing apparatus according to claim 2, wherein the level number is a level number of a group including plural levels having structures similar to each other.

4. The polishing apparatus according to claim 2, wherein the model equation is a multiple regression equation created from a multiple regression analysis on data including removal amounts of the object material on plural substrates polished, integrated values of the torque current, cumulative operating times of said dresser, and level numbers.

5. A method for polishing a substrate comprising:

creating a model equation for calculating a removal amount of an object material to be polished on the substrate, the object material belonging to one of a plurality of levels of a multi-level interconnect structure, the model equation containing a variable representing an integrated value of a torque current of a motor, a variable representing a cumulative operating time of a dresser, and variables representing a level number to which the object material belongs, wherein the motor is configured to drive a polishing table for holding a polishing pad having a polishing surface, and wherein the dresser is configured to dress the polishing surface;

polishing the object material by bringing the object material into sliding contact with the polishing surface; and calculating the removal amount of the object material by quantifying the level number to which the object material belongs using the model equation and by substituting the cumulative operating time of the dresser and the integrated value of the torque current of the motor when polishing the object material into the model equation.

6. The method according to claim 5, further comprising:

stopping said polishing of the object material when the removal amount calculated reaches a preset target value.

7. The method according to claim 5, wherein the object material comprises a film.

8. The method according to claim 7, wherein the level number is a level number of a group including plural levels having structures similar to each other.

9. The method according to claim 7, wherein the model equation is a multiple regression equation created from a multiple regression analysis on data including removal amounts of the object material on plural substrates polished, integrated values of the torque current, cumulative operating times of the dresser, and level numbers.

* * * * *